United States Patent [19]

Wiencek et al.

[11] Patent Number: 5,062,202

[45] Date of Patent: Nov. 5, 1991

[54] TWISTED CABLE POSITIONING TRAY

[75] Inventors: Donald C. Wiencek, Tinley Park; Robert J. Brown, Mokena, both of Ill.

[73] Assignee: Panduit Corp., Tinley Park, Ill.

[21] Appl. No.: 632,225

[22] Filed: Dec. 21, 1990

[51] Int. Cl.[5] ..... H01R 43/01

[52] U.S. Cl. ..... 29/749

[58] Field of Search ..... 29/749, 857; 140/147; 269/43, 903

[56] References Cited

U.S. PATENT DOCUMENTS 4,020,540 5/1977 Casciotti et al. .
4,295,254 10/1981 Adams et al. .
4,393,580 7/1983 Hall, Jr. .
4,554,733 11/1985 Caveney .
4,911,210 3/1990 Hillegonds .
4,928,379 5/1990 Paquin et al. .
4,954,100 9/1990 McCleerey ..... 29/857

*Primary Examiner*—Lowell A. Larson

*Attorney, Agent, or Firm*—Charles R. Wentzel; Mark D. Hilliard

[57] ABSTRACT

A twisted flat cable positioning tray includes a cable tray having a slide for covering and securing a multisection flat cable having one section of the cable twisted 180 degrees to accurately position the twisted cable for termination to a connector in a connector press.

5 Claims, 4 Drawing Sheets

TWISTED CABLE POSITIONING TRAY

BACKGROUND OF THE INVENTION

The present invention relates generally to cable positioning trays utilized to accurately present cables relative to a connector termination tool for subsequent termination of a connector to a cable.

The use of one type of cable positioning tray is illustrated in U.S. Pat. No. 4,911,210 to Hillegonds owned by our common assignee. This type of cable positioning tray is utilized for the special application of accurately positioning round-flat cable for subsequent termination of a connector thereto.

Another type of special cable termination consists of a flat cable having a twisted section which must be manipulated and accurately positioned to effect termination of the twisted flat cable to a connector.

SUMMARY OF THE INVENTION

It is the object of the present invention to provide an improved cable tray that simply and accurately positions a twisted flat cable for subsequent termination to a connector in a connector applying press.

In general, a cable tray for positioning a twisted flat cable includes a cable tray for positioning a multiconductor cable having a twisted longitudinal section in a connector application tool, comprising:

planar positioning means for accurately laterally positioning the multiconductor cable;

cable tray positioning means for positioning the cable tray relative to the connector application tool; and slide means for covering and securing the twisted multiconductor cable in an accurately aligned disposition on the planar positioning means after it has been initially placed on the cable tray positioning means, the slide means being mounted adjacent the planar positioning means to reciprocate between a first position extending fully across the width of the twisted cable and a second position completely retracted from the width of the twisted cable.

DESCRIPTION OF THE PREFERRED EMBODIMENT

Figure 1:
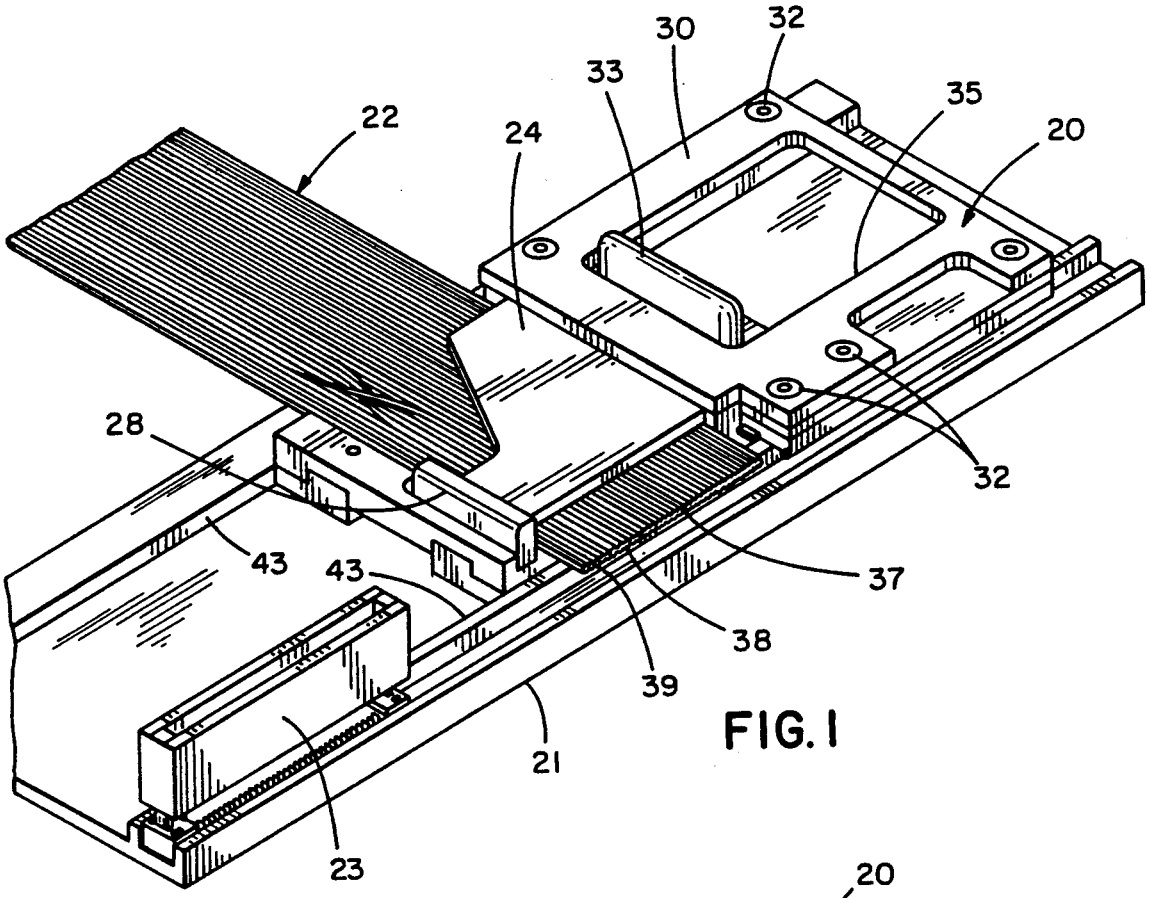
FIG. 1 is a perspective view of a cable tray embodying the concept of the present invention positioned in a connector press base of the termination tooling within which it is slidably carried.
Figure 2:
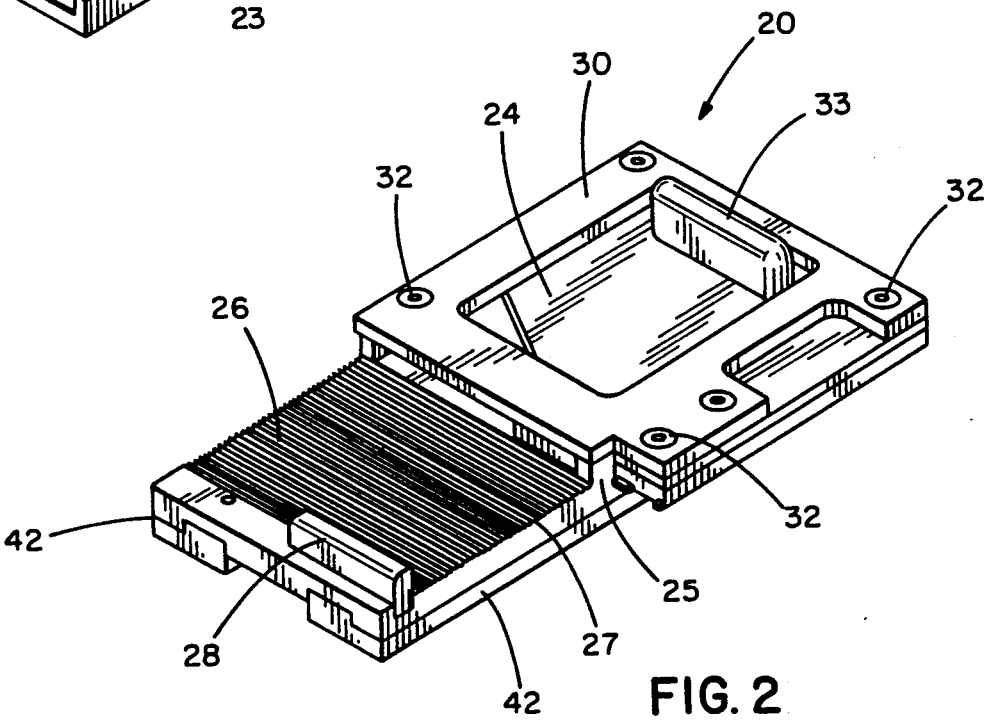
FIG. 2 is a perspective view of the cable tray of FIG. 1.
Figure 3:
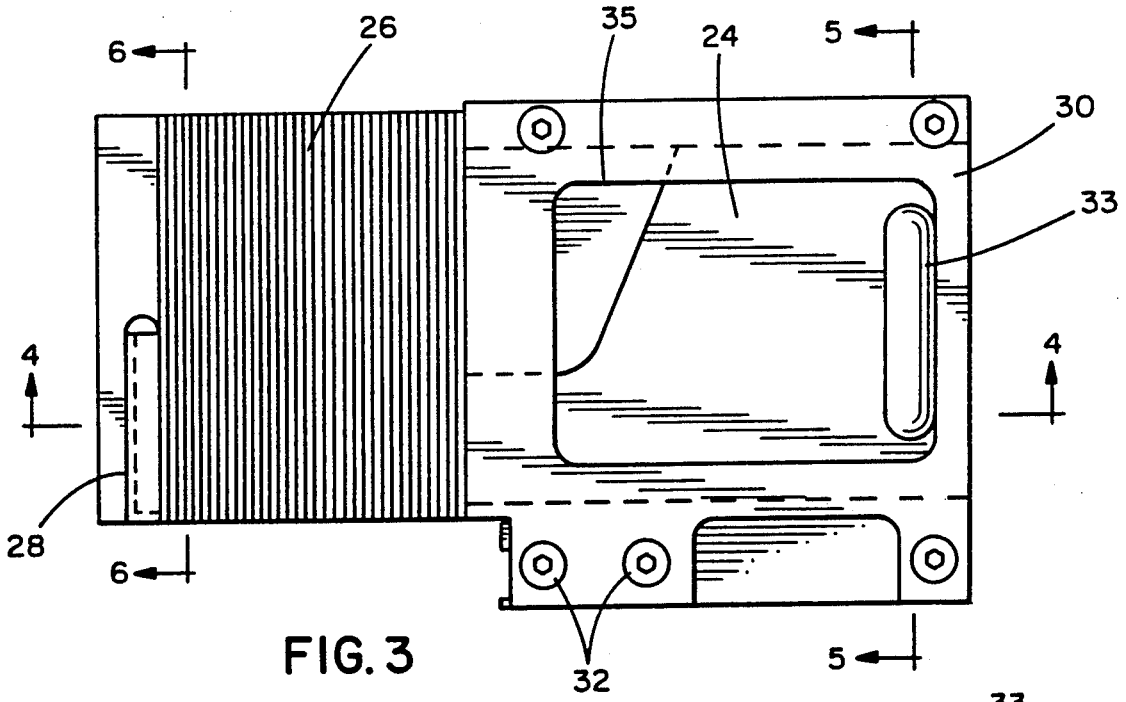
FIG. 3 is a top view of the cable tray of FIG. 1.

A cable tray embodying the concept of the present invention is designated generally by the numeral 20 in the accompanying drawings. Cable tray 20 is slidably mounted within a connector press base 21 of FIG. 1 to present a flat cable 22 for termination within a connector 23 by a connector press, which is not shown, in a manner identical to that taught in U.S. Pat. No. 4,554,733 to Caveney owned by our common assignee, Panduit Corp., which is incorporated herein by reference.

Figure 8:
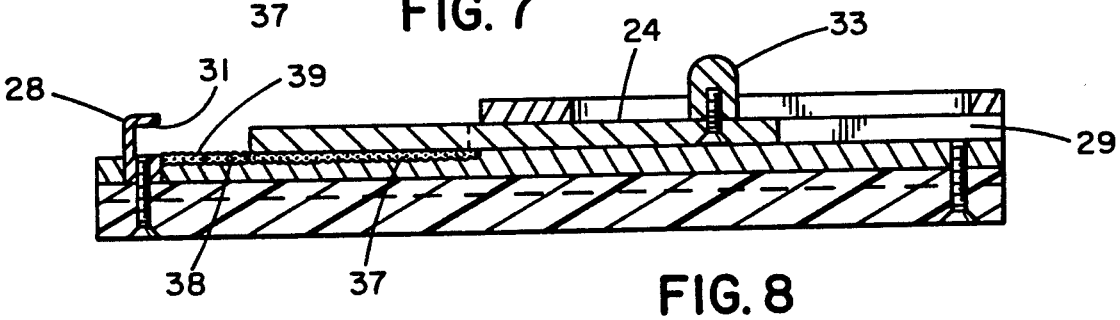
FIG. 8 is a sectional view taken along line 8—8 of FIG. 7.

Cable tray 20 includes a cable slide 24, a metal plate 25, and a planar cable positioning surface 26 disposed on metal plate 25, with surface 26 having a plurality of parallel conductor positioning grooves 27 formed thereon to accept and laterally align individual conductors of flat cable 22. Cable tray 20 also includes a slide stop 28 and slide mounting slot 29 best seen in FIG. 8.

Cable slide 24 is mounted for reciprocative sliding movement within mounting slot 29 defined by a metal upper plate 30 which is secured to metal plate 25 by screws 32.

Figure 4:
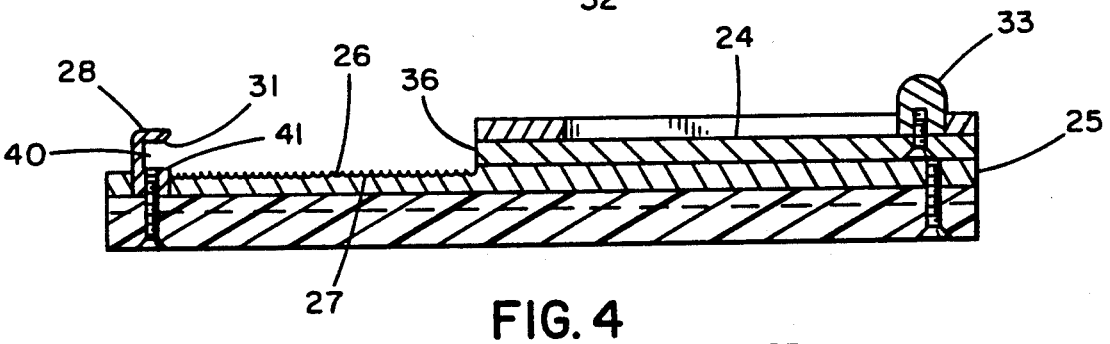
FIG. 4 is a sectional view taken along line 4—4 of FIG. 3.
Figure 5:
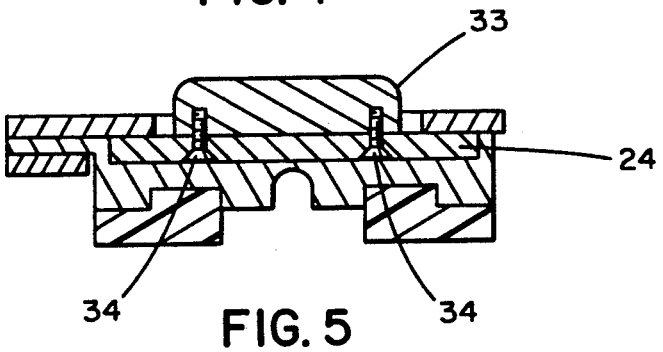
FIG. 5 is a sectional view taken along line 5—5 of FIG. 3.
Figure 6:
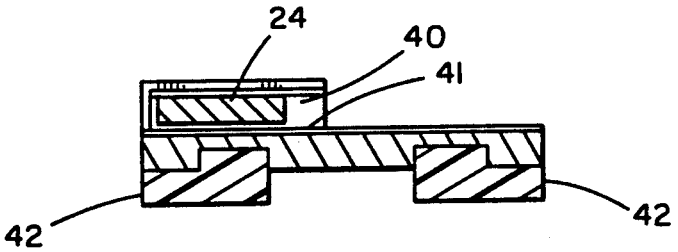
FIG. 6 is a sectional view taken along line 6—6 of FIG. 3.
Figure 12:
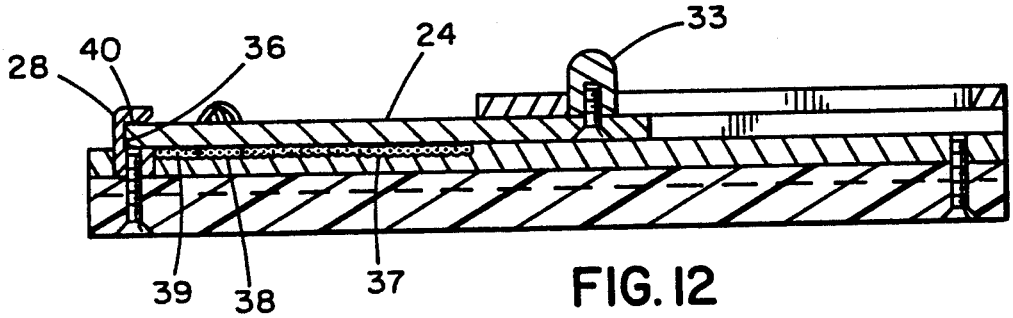
FIG. 12 is a sectional view taken along line 12—12 of FIG. 11.
Figure 13:
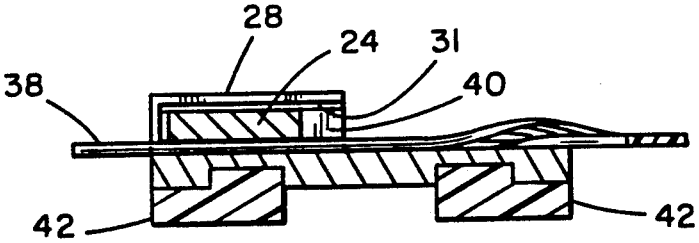
FIG. 13 is a sectional view taken along line 13—13 of FIG. 11.

Handle 33 is secured to cable slide 24 by screws 34 (as seen in FIG. 5) in a position to project upwardly through a window 35 formed in upper plate 30. As seen in FIG. 5, cable slide 24 extends across the width of mounting slot 29 to provide for accurate translation of cable slide 24 between a first position extending completely across cable positioning surface 26 (where a distal edge positioning edge 36 of slide 24 abuts slide stop 28) to a second position completely retracted from cable positioning surface 26 (where handle 33 abuts an edge of window 35). Cable stop 28, as seen in FIG. 4, includes a slot 37 having a lower edge 38 disposed above and spaced from cable positioning surface 26 the thickness of cable 22. As seen in FIG. 12, distal edge 36 is received in slot 37 to accurately position and limit the movement of cable slide 24 relative to surface 26 and cable 22. Slot 37 includes an angled surface 31 which tapers inwardly to gradually direct cable slide 24 downwardly as it is translated into slot 37.

Straight distal positioning edge 36 is aligned with grooves 27 and thus the axis of the conductors of cable 22 when they are positioned on surface 26. Cable 22 is slit twice longitudinally between adjacent conductors to form first, second and third sections 37, 38 and 39 each respectively having 24, 5 and 5 conductors.

Figure 7:
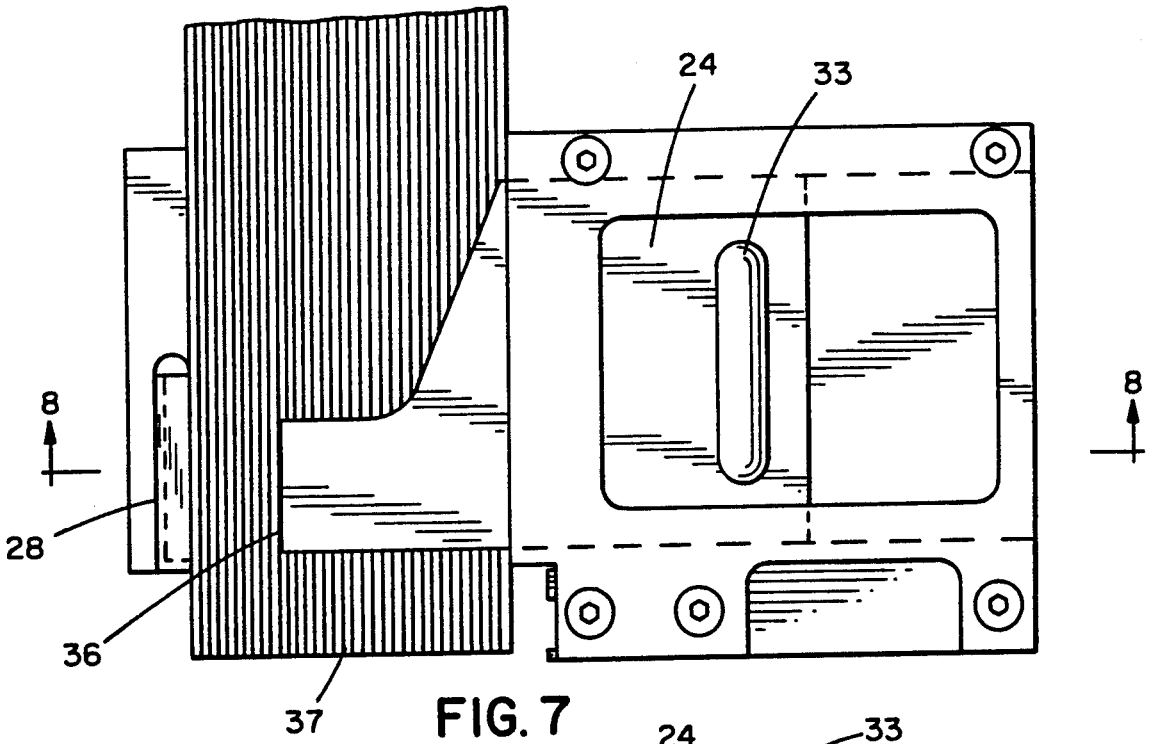
FIG. 7 is a top view of the cable tray of FIG. 2 showing the cable tray slide positioned over a first section of a multiconductor cable.
Figure 9:
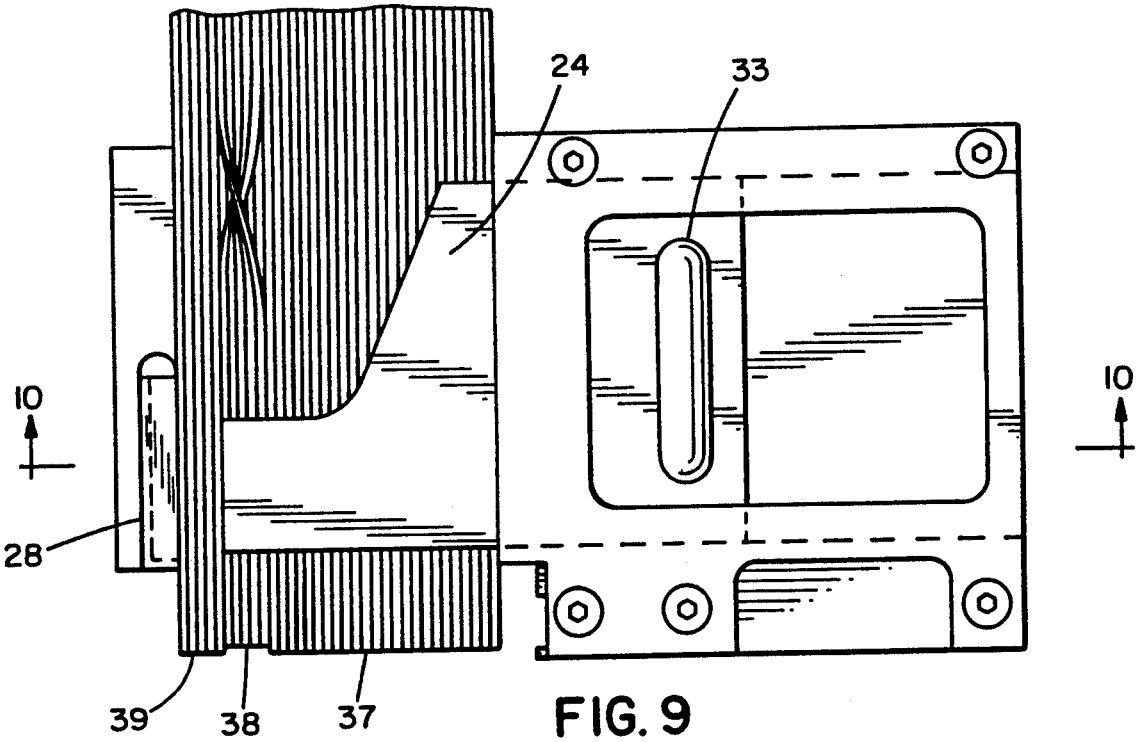
FIG. 9 is a top view of the cable tray of FIG. 2 showing the cable slide positioned over a second twisted section of the multiconductor cable.
Figure 10:
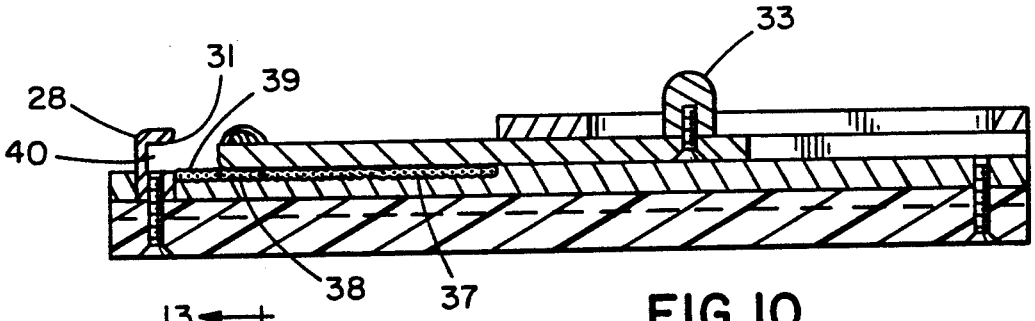
FIG. 10 is a sectional view taken along line 10—10 of FIG. 9.
Figure 11:
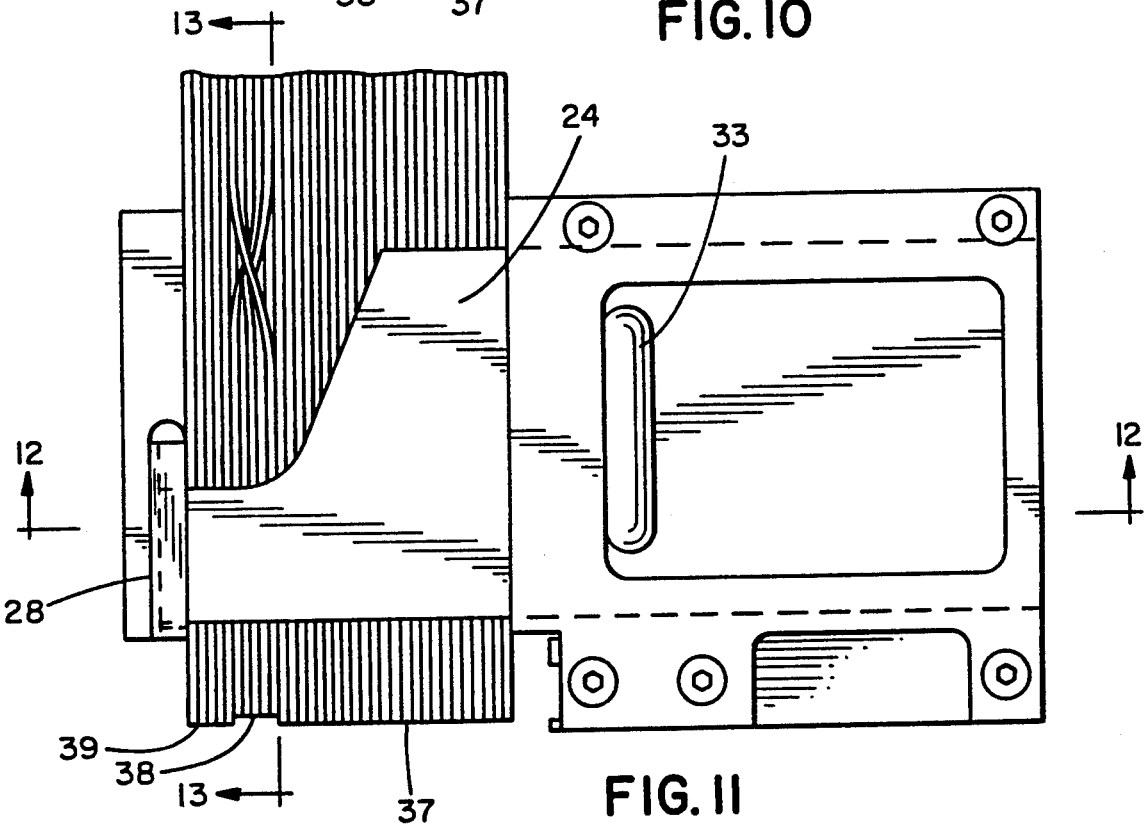
FIG. 11 is a top view of the cable tray of FIG. 1 showing the cable tray slide positioned across the width of the multiconductor cable.

FIGS. 7, 9 and 11 respectively depict the method of positioning a twisted flat cable on tray 20, which includes the steps of manually positioning first cable section 37 on surface 26 and sliding cable slide 24 over a first cable section 37 and positioning edge 36 of slide 24 in covering alignment with the last conductor in first cable section 37, twisting second cable section 38 180 degrees and manually positioning second cable section 38 on surface 26, as seen in FIG. 9, and sliding cable slide 24 over twisted second cable section 38, and finally positioning third cable section 39 on surface 26 and sliding cable slide 24 over third cable section 39.

As seen in FIGS. 1 and 5, cable tray 20 includes lateral positioning edges 42 disposed to engage tray positioning edges 43 to accurately position the cable tray relative to the connector press.

We claim:

1. A cable tray for positioning a multiconductor cable having a twisted longitudinal section in a connector application tool, comprising:

planar positioning means for accurately laterally positioning the multiconductor cable;

cable tray positioning means for positioning the cable tray relative to the connector application tool; and slide means for covering and securing the twisted multiconductor cable in an accurately aligned planar disposition on the planar positioning means after it has been initially placed on the cable tray positioning means, the slide means being mounted adjacent the planar positioning means to reciprocate between a first position extending fully across the width of the twisted cable and a second position completely retracted from the width of the twisted cable.

2. A cable tray as set forth in claim 1, wherein the planar positioning means includes a plurality of parallel positioning grooves disposed to accept and laterally align individual conductors of the multiconductor cable.

3. A cable tray as set forth in claim 2, wherein the planar positioning means includes a slide positioning stop means disposed along a peripheral edge of the planar positioning means in a position to abut the distal edge of the slide means when it was fully extended.

4. A cable tray as set forth in claim 3, wherein the slide positioning stop includes a slot formed opposite to the distal edge of the slide means in a position to accept the distal edge and accurately position the slide means with respect to the planar positioning means.

5. A method of positioning a twisted multiconductor cable on a cable tray for subsequent termination of the cable to a connector comprising the steps of:

providing a cable tray for positioning a multiconductor cable having planar positioning means for accurately laterally positioning the multiconductor cable; cable tray positioning means for positioning the cable tray relative to the connector application tool; and slide means for covering and securing the twisted multiconductor cable in an accurately aligned disposition on the planar positioning means after it has been initially placed on the cable tray positioning means, the slide means being mounted adjacent the planar positioning means to reciprocate between a first position extending fully across the width of the twisted cable and a second position completely retracted from the width of the twisted cable;

positioning a first portion of the flat cable on the planar positioning means and sliding the slide means to a position overlying the first portion of the multiconductor cable;

positioning a second portion of the multiconductor cable adjacent the first portion on the planar positioning means and sliding the slide means to a position overlying the second portion of the multiconductor cable; and repeating the above steps for each adjacent portion of the multiconductor cable wherein at least one portion of the cable has been twisted 180 degrees from its as manufactured orientation.

* * * * *

UNITED STATES PATENT AND TRADEMARK OFFICE

CERTIFICATE OF CORRECTION

PATENT NO. : 5,062,202

DATED : November 5, 1991

INVENTOR(S) : Wiencek et al.

It is certified that error appears in the above-identified patent and that said Letters Patent is hereby corrected as shown below:

Column 2, line 43, change "37" to --40--.

Column 2, line 43, change "38" to --41--.

Column 2, line 46, change "37" to --40--.

Column 2, line 48, change "37" to --40--.

Column 2, line 50, change "37" to --40--.

Signed and Sealed this

Thirtieth Day of March, 1993

*Attest:*

STEPHEN G. KUNIN

*Attesting Officer*

*Acting Commissioner of Patents and Trademarks*